US006391510B1

(12) United States Patent
Ishiyama et al.

(10) Patent No.: US 6,391,510 B1
(45) Date of Patent: May 21, 2002

(54) TONER FOR DEVELOPING ELECTROSTATIC LATENT IMAGE, PROCESS FOR PRODUCING THE SAME, DEVELOPER AND PROCESS FOR PRODUCING IMAGE

(75) Inventors: Takao Ishiyama; Manabu Serizawa; Takeshi Shoji; Yasuo Matsumura; Hideo Maehata, all of Minamiashigara (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/641,563

(22) Filed: Aug. 18, 2000

(30) Foreign Application Priority Data

Sep. 8, 1999 (JP) ..... 11-254293

(51) Int. Cl.[7] ..... G03G 9/08

(52) U.S. Cl. ..... 430/111.4; 430/137.14; 430/124; 430/125; 430/109.3

(58) Field of Search ..... 430/111.4, 110.3, 430/110.4, 109.1, 137.14, 124, 125, 126

(56) References Cited

U.S. PATENT DOCUMENTS 5,502,110 A * 3/1996 Matsumoto et al. ..... 525/221
5,578,408 A * 11/1996 Kohtaki et al. ..... 430/111.4
6,132,921 A * 10/2000 Ishiyama et al. ..... 430/111.4

FOREIGN PATENT DOCUMENTS

| | | |
|---|---|---|
| JP | A-59-218459 | 12/1984 |
| JP | A-59-218460 | 12/1984 |
| JP | A-63-282752 | 11/1988 |
| JP | A-4-69666 | 3/1992 |
| JP | A-5-61239 | 3/1993 |
| JP | A-6-250439 | 9/1994 |
| JP | A-9-258481 | 10/1997 |
| JP | A-10-221987 | 8/1998 |
| JP | 3067761 B1 * | 5/2000 |

OTHER PUBLICATIONS

Alger, Mark S. Polymer Science Dictionary. London: Elsevier Science Publishers, Ltd. pp. 93, 184, 185, 270. (1990).*

* cited by examiner

*Primary Examiner*—Christopher Rodee
(74) *Attorney, Agent, or Firm*—Oliff & Berridge, PLC

(57) ABSTRACT

The invention relates to a toner for developing an electrostatic latent image, a process for producing the same, a developer for an electrostatic latent image, and a process for forming an image, and the toner contains a binder resin and a coloring agent and has a molecular weight between crosslinking points Mc obtained by a measurement of temperature dispersion on dynamic viscoelasticity of from $3.6\times10^6$ to $7.5\times10^8$, and the molecular weight between crosslinking points Mc and a crosslinking density Me satisfying the relationship $14.0 \leqq \mathrm{Log}_{10}(Mc/Me) \leqq 16.5$.

19 Claims, 1 Drawing Sheet

TONER FOR DEVELOPING ELECTROSTATIC LATENT IMAGE, PROCESS FOR PRODUCING THE SAME, DEVELOPER AND PROCESS FOR PRODUCING IMAGE

FIELD OF THE INVENTION

The present invention relates to a toner and a process for producing the same that is used for developing an electrostatic latent image formed by an electrophotographic method and an electrostatic recording method, a developer for an electrostatic latent image, and a process for producing an image.

BACKGROUND OF THE INVENTION

A method of visualizing image information via an electrostatic image, such as an electrophotographic method, is utilized in various field of art. In the electrophotographic method, an electrostatic static latent image is formed on a photoreceptor through charging and exposure steps, and the electrostatic latent image is developed with a developer containing a toner, which is then visualized through transfer and fixing steps.

As the developer used herein, a two-component developer containing a toner and a carrier and a one-component developer solely using a magnetic toner or a non-magnetic toner are known.

The production of the toners are generally conducted by a kneading and pulverization method, in which a thermoplastic resin is melted and kneaded with a pigment, a charge controlling agent and a releasing agent, such as a wax, and after cooling, it is finely pulverized and classified. In order to improve the fluidity and the cleaning property, inorganic or organic fine particles are sometimes added to the surface of the toner particles depending on necessity. While a toner of good quality can be produced by the process described, the following problems are involved.

The shape of the toner and the surface structure of the toner do not become constant by using the ordinary kneading and pulverization method, and they are delicately changed depending on the pulverization property of the material used and the pulverization conditions. Therefore, it is difficult to positively control the shape of the toner and the surface structure of the toner. Furthermore, there is restriction on the selection of the material in the kneading and pulverization method. Specifically, it is necessary that the dispersion body of the resin containing the coloring agent dispersed therein is sufficiently brittle and can be finely pulverized by an apparatus that can be practically employed from the standpoint of economy.

However, when the dispersion body of the resin and the coloring agent is brittle, there are cases where fine powder is formed or the shape of the toner is changed due to a mechanical sharing force in a developing device. As a result, the fine powder is fixed on the surface of the carrier to accelerate deterioration of the charging property of the developer in the two-component developer, and the particle size distribution is broadened to cause the toner-smoke and the developing property is lowered by the change of the toner shape to deteriorate the image quality in the one-component toner.

In the case of toner to which a large amount of a releasing agent such as wax is internally added, the releasing agent is often exposed on the surface of the toner depending on the combination with the thermoplastic resin, so as to influence the property of the toner. Particularly, in the case of a combination of a resin that is relatively difficult to be pulverized owing to a high elasticity due to a high molecular weight component and brittle wax such as polyethylene, exposure of the polyethylene on the toner surface is often observed. This phenomenon is advantageous for the releasing property on fixing and the cleaning of a non-transferred toner on the photoreceptor, but the polyethylene on the surface layer is easily transferred by a mechanical force to contaminate the developing roll, the photoreceptor and the carrier, which brings about reduction in reliability.

Furthermore, when the shape of the toner is irregular, the fluidity cannot be sufficiently ensured even though a fluidizing aid is added, and thus the fine particles on the surface of the toner migrate to concave parts of the toner by a mechanical sharing force upon use to lower the fluidity with the lapse of time, or the fluidizing aid is buried inside the toner to deteriorate the developing property, the transfer property and the cleaning property. Furthermore, in the case where a toner recovered by cleaning is reused by bringing back to the developing device, the image quality is liable to be lowered. When the amount of the fluidizing aid is increased to prevent the problems, other problems occur in that black spots are formed on the photoreceptor, and the particles of the aid are scattered.

In recent years, as a method for positively controlling the shape and the surface structure of the toner, a process for producing a toner by an emulsion polymerization and aggregation method has been proposed in JP-A-282752/1988 and JP-A-250439/1994. In the method, a resin fine particle dispersion is firstly prepared by emulsion polymerization, and separately, a coloring agent dispersion is prepared by dispersing a coloring agent in a solvent, followed by mixing and heating both the dispersion to produce a toner through fusing and coalescence. While the shape of the toner can be controlled in a certain extent to improve the charging property and the durability in this process, because the internal structure becomes substantially uniform, there are problems in the releasing property of a fixing sheet on fixing and in the stability of transparency on outputting on an OHP sheet.

As described in the foregoing, in the electrophotographic process, in order to stably maintain the performance of the toner even under various kinds of mechanical stress, it is necessary that the exposure of the releasing agent on the toner surface is controlled, and the surface hardness is increased without deteriorating the fixing property, so as to increase the mechanical strength of the toner itself and to sufficiently maintain both the charging property and the fixing property.

Owing to increase in demand for high image quality in recent years, there are considerable trends of reduction in particle diameter of the toner to realize an image of high definition particularly in the formation of a color image. However, when the particle diameter is simply decreased maintaining the conventional particle size distribution, problems of contamination of the carrier and the photoreceptor and the toner-smoke due to the presence of the toner as fine particles become outstanding, and it is difficult to simultaneously realize both the high image quality and the high reliability. In order to solve the problem, it becomes important that the particle diameter is decreased, and simultaneously the particle size distribution is sharpened.

In digital full-color duplicator and printer in recent years, a color image is subjected to color separation by filters of B (blue), R (red) and G (green), and a latent image formed with dots having a diameter of from 20 to 70 μm corresponding to the original image is developed by using toners of Y (yellow), M (magenta), C (cyan) and Bk (black) with utilization of the subtractive color mixing. In comparison to an ordinary monochrome duplicator, it is necessary that a full-color duplicator transfers a large amount of a toner and handles a small dot diameter, and therefore the importance of the uniform charging property, the stability, the toner strength and the sharpness of the particle size distribution is increased. In order to meet the high-speed performance and the energy saving property of the apparatus, the further low temperature fixing property is demanded. Therefore, the aggregation and fusing/coalescence process which is suitable to produce such toner with sharpness of particle size distribution and with small particle diameter is preferred to impart excellent characteristics to the toner.

Because a large amount of toners is installed in a full color duplicator, it is necessary to sufficiently conduct color mixing thereof, and improvement in color reproducibility and transparency on OHP on color mixing becomes necessary.

As a component of the releasing agent, polyolefin series wax is generally used to prevent low temperature offset upon fixing, which is internally added to the toner. In addition to this, a slight amount of a silicone oil is uniformly coated on a fixing roller to improve the high temperature offset property. Therefore, there is a problem of causing uncomfortable sticky feeling due to attachment of the silicone oil to the transfer material.

JP-A-61239/1993 proposes a toner suitable for oilless fixing, in which no oil is coated on a fixing roll, by incorporating a large amount of a releasing agent component in the toner. However, when a large amount of releasing agent is added, the releasing property can be certainly improved, but the binder resin component and the releasing agent are dissolved in each other, and oozing of the releasing agent becomes non-uniform, so as to damage the stability of releasing. Furthermore, there are cases where a free component of the releasing agent causes charging inhibition.

As methods for solving the problems, a method of adding a high molecular weight component to increase the rigidity of the binder resin is proposed in JP-A-69666/1992 and JP-A-258481/1997, and a method of introducing crosslinking to the binder resin to supplement the rigidity is proposed in JP-A-218460/1984 and JP-A-218459/1984.

However, when a crosslinking component is added to the binder resin in the later case, because the rigidity of the binder resin is increased, the flexibility of a fixed image becomes poor. Particularly, when only the molecular weight of the crosslinking agent is increased in JP-A-218460/1984, the molecular weight between the crosslinking points is increased to slightly improve the flexibility of the fixed image itself, but because both the molecular weight and the crosslinking density of the binder resin are not simultaneously controlled, it is difficult that the releasing property, the gloss of the surface of the fixed image and the transparency on OHP cannot be simultaneously attained with maintaining the sufficient flexibility. In particular, a sufficient fixed image cannot be obtained when it is used in a fixing device of an energy saving type or a duplicator or a printer of a high printing speed disclosed in JP-A-221987/1998.

SUMMARY OF THE INVENTION

The invention has been made to solve the problems and to provide a toner for developing an electrostatic latent image, a process for producing the same, a developer for an electrostatic latent image, and a process for forming an image in that the adhesion property of a fixed image to a fixing sheet, the peeling property of a fixing sheet, the hot offset resisting property, the flexibility of a fixed image, the gloss of the surface of the fixed image and the transparency on OHP are excellent, the uniformity and the stability in charging are high, fogging and scattering of the toner are caused, and an image of high quality can be formed.

The inventors have been conducted earnest investigations mainly in the molecular weight between crosslinking points Mc and the crosslinking density Me, and as a result, it has been found that the problems are solved by the following configurations.

The present invention provides a toner for developing an electrostatic latent image containing a binder resin and a coloring agent, the toner having a molecular weight between crosslinking points Mc obtained by a measurement of temperature dispersion on dynamic viscoelasticity of from $3.6\times10^6$ to $7.5\times10^8$, and the molecular weight between crosslinking points Mc and a crosslinking density Me satisfying the relationship: $14.0 \leqq \mathrm{Log}_{10}(Mc/Me) \leqq 16.5$. The toner may have a glass transition temperature Tg of from 45 to 52° C. The toner may have a weight average molecular weight in a range of from 25,000 to 55,000. The toner may have a volume average particle size distribution index GSDv of 1.30 or less, and a ratio of the volume average particle size distribution index GSDv and a number average particle size distribution index GSDp of 0.95 or more. The toner may have a shape factor SF1 in a range of from 100 to 140. The coloring agent contained in the toner may have a central diameter in a range of from 100 to 330 nm measured by a transmission electron microscope (TEM). An amount of the coloring agent in the toner may be in a range of from 4 to 15% by weight based on a total weight of the toner. The toner may further contains a releasing agent. An amount of the releasing agent in the toner may be in a range of from 5 to 25% by weight based on a total weight of the toner. The toner may have an absolute value of a charging amount of from 20 to 40 μC/g.

The present invention also provides a process for producing a toner for developing an electrostatic latent image, the process containing a step of mixing a resin particle dispersion containing resin particles dispersed therein and a coloring agent dispersion containing a coloring agent dispersed therein to aggregate fine particles, and a step of fusing the aggregated particles by heating. The process may further contains, after the aggregationn step, a step of additionally mixing the resin particle dispersion. The step of aggregating the fine particles may contain mixing a releasing agent dispersion. A polymer of a metallic salt may be used in the step of aggregating the fine particles.

The toner may be used as a developer with a carrier particles.

The present invention also provides a process for producing an image containing a step of developing an electrostatic latent image formed on a latent image holding member with the developer, a step of transferring a toner image thus formed to a transfer material, and a step of fixing the toner image to the transfer material. The process may further contains, after transferring step, a step of recovering the toner remaining on the latent image holding member, and a recycle step of bringing the recovered toner to the developer. A cleaning step may not be conducted after the transferring step. The fixing step may be conducted by using a belt in the fixing step.

DETAILED DESCRIPTION OF THE INVENTION

Figure 1:
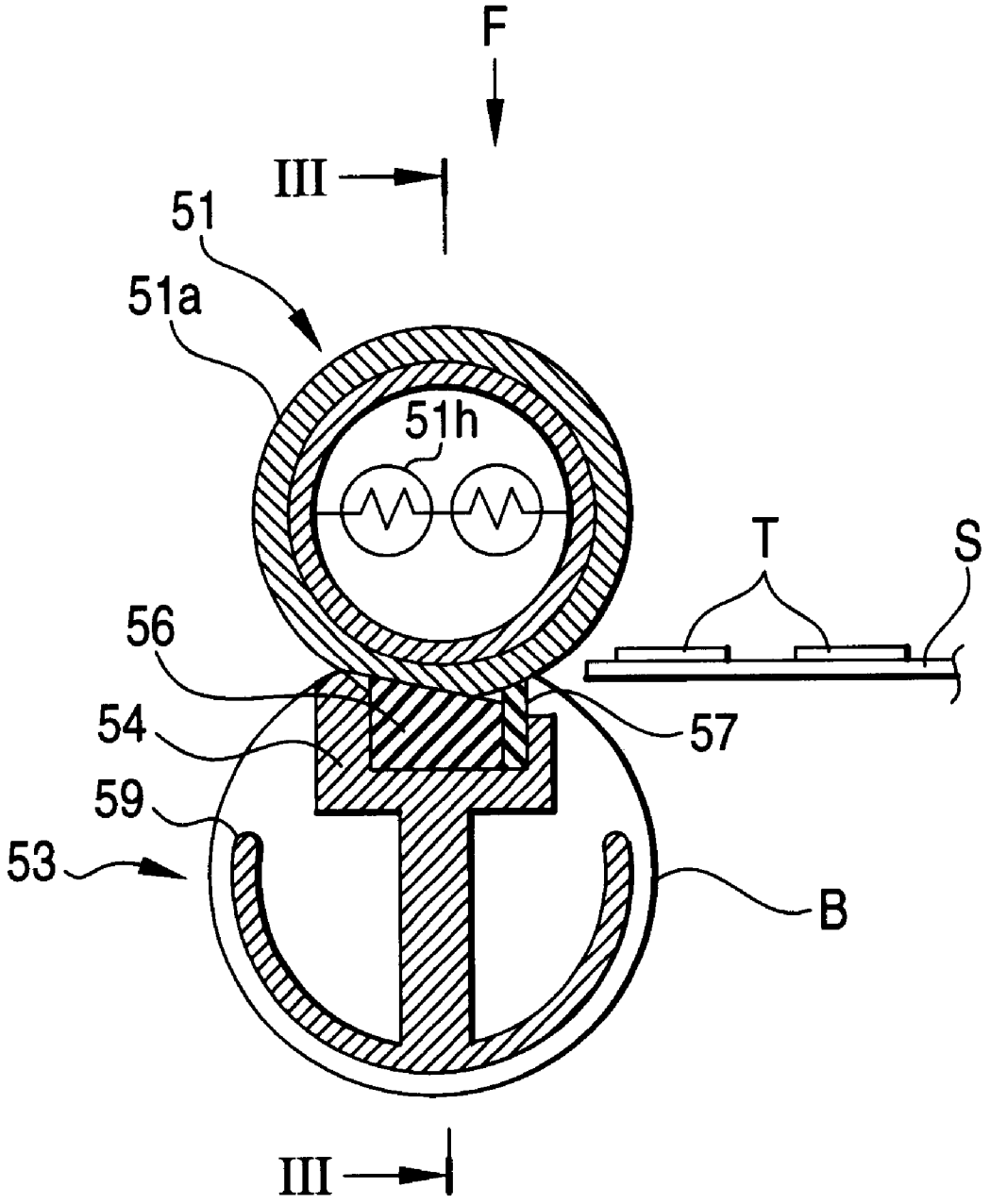
FIG. 1 is a schematic diagram showing one embodiment of a fixing device using a belt employed in the invention.

In the invention, the toner has a molecular weight between crosslinkingpoints Mc of from $3.6\times10^6$ to $7.5\times10^8$ and maintains the relationship between the molecular weight between crosslinking points Mc and a crosslinking density Me of $14.0\leqq Log_{10}(Mc/Me)\leqq 16.5$, whereby the adhesion property of a fixed image to a fixing sheet, the peeling property of a fixing sheet, the hot offset resisting property, the flexibility of a fixed image, the gloss of the surface of the fixed image and the transparency on OHP are simultaneously improved, the uniformity and the stability in charging are high, fogging and smoking of the toner are caused, and thus an image of high quality can be formed.

The molecular weight between crosslinking points Mc of the toner in the invention is obtained by measuring a storage elastic modulus G' and a loss elastic modulus G" in temperature dispersion measurement of dynamic viscoelasticity by a sine wave vibration method. The measurement of the dynamic viscoelasticity is conducted by using an ARES measuring apparatus produced by Rheometric Scientific, Inc.

The temperature dispersion measurement of dynamic viscoelasticity in the invention is conducted in the following manner. A toner is formed into tablets which are set on a parallel plate having a diameter of 25 mm, and after setting a normal force at 0, sine wave vibration is applied thereto at a vibration frequency of from 0.1 to 110 rad/sec. The measurement is started at 60° C. and continued until 200° C. The interval of measurement time is 30 seconds, the temperature adjustment accuracy after the start of the measurement is ±1.0° C. or less, and the temperature increasing rate after starting the measurement is 1° C. per minute. The distortion amount at the measuring temperature is maintained at a suitable value and is appropriately adjusted to obtain normal measurement values. The storage elastic modulus is obtained from the measurement results obtained at the respective measurement temperatures.

In the case where a rubber-like flat region (plateau region) is observed, an apparent crosslinking density (crosslinking points) is calculated from the following equations using the value of the storage elastic modulus G' at the central temperature T° C., which is thus designated as the crosslinking density Me in the invention:

$$G'=3\phi_{en}MeRT$$

$$Me=G'/3\phi_{en}RT$$

wherein $\phi_{en}$ represents a front factor, R represents the gas constant, and T represents a central temperature of the rubber-like flat region.

An apparent molecular weight between crosslinking points is obtained by the following equation using the storage elastic modulus G', which is designated as the molecular weight between crosslinking points Mc in the invention:

$$Mc=3dRT/G'$$

wherein d represents a density of the toner.

In general, the conjuncture of molecular chains of the binder resin inside the toner influences the extent of coagulation property of the binder resin itself. That is, the formation of crosslinking (conjuncture) restricts the freedom of mobility of the molecular chain itself of the binder resin, and thus increases the rigidity of the binder resin. Furthermore, when the amount of the crosslinking (conjuncture) points is larger, the coagulation force is increased, and the fusing property of the binder resin itself is decreased. The flexibility of the binder resin is simultaneously decreased.

The formation of crosslinking (conjuncture) improves the hot offset resisting property on fixing, but decreases the gloss of the fixed image. The conditions of the conjuncture are generally expressed by the molecular weight between crosslinking (conjuncture) points and the crosslinking (conjuncture) density. The larger the crosslinking density is, and the smaller the molecular weight between the crosslinking points is, the larger the rigidity of the toner image is.

It is important to maintain the fixing property of the toner to the fixing sheet (such as paper and an OHP sheet) and a suitable extent of flexibility of the fixed image itself, and in general, it is difficult to sufficiently satisfy the bending resistance, the fixing property and the hot offset resistance of the image only by the introduction of the conjuncture structure. Therefore, it is important to simultaneously control both the molecular weight between crosslinking points and the crosslinking density, which indicate the extent and intensity of the conjuncture structure.

The molecular weight between crosslinking points Mc obtained by the temperature dispersion measurement of dynamic viscoelasticity of the toner of the invention is in a range of from $3.6\times10^6$ to $7.5\times10^8$, and the molecular weight between crosslinking points Mc and the crosslinking density Me satisfies the relationship $14.0\leqq Log_{10}(Mc/Me)\leqq 16.5$, whereby a toner excellent in the fixing property, such as the adhesion property of the fixed image, the peeling property of the fixed image, the bending resistance of the fixed image, and the surface gloss and the OHP transparency of the fixed image can be obtained.

When the molecular weight between crosslinking points Mc is lower than $3.6\times10^6$ and/or $Log_{10}(Mc/Me)$ is lower than 14.0, the rigidity of the binder resin is increased, so as to decrease the gloss property, the OHP transparency, the fixing property and bending resistance of the fixed image. When the molecular weight between crosslinking points Mc is higher than $7.5\times10^8$ and/or $Log_{10}(Mc/Me)$ is higher than 16.5, the rigidity of the binder resin itself is lowered to improve the gloss property and the OHP transparency, but the peeling property on oilless fixing and the bending resistance of the fixed image are deteriorated. When the molecular weight between crosslinking points Mc is higher than $7.5\times10^8$ and $Log_{10}(Mc/Me)$ is lower than 14.0, the bending strength of the fixed image is good, but the gloss property and the OHP transparency are slightly decreased. When the molecular weight between crosslinking points Mc is higher than $3.6\times10^6$ and $Log_{10}(Mc/Me)$ is higher than 16.5, the gloss property, the fixing property, the bending resistance and the OHP transparency of the fixed image are good, but the peeling property on oilless fixing is lowered.

The toner particles for developing an electrostatic image of the invention are produced, for example, by the following manner.

A resin fine particle dispersion having a particle diameter of 1 μm or less polymerized by emulsion polymerization, a coloring agent particle dispersion, and depending on necessity, a releasing agent particle dispersion are previously prepared, which are appropriately combined and mixed along with a polymer of a metallic salt such as Al, so as to form aggregated particles containing the resin fine particles and the coloring agent particles, and then they are heated to a temperature higher than the glass transition point of the resin fine particles to conduct fusion and coalescence, as well as washing and drying, whereby toner particles are obtained. It is preferred in the invention that after forming the aggregated particles in the manner described in the foregoing, a step is provided, in which a resin fine particle dispersion is further added and mixed thereto to form adhered particles containing the resin fine particles adhered on the surface of the aggregated particles, and then the adhered particles are subjected to fusion and coalescence to form a resin film on the surface of the toner particles, whereby exposure of the releasing agent is prevented.

In the foregoing production process, it is possible that a dispersion of the resin fine particles using an ionic surfactant is used and mixed with a coloring agent dispersion dispersed in another ionic surfactant having the opposite polarity to conduct heterogeneous aggregation, so as to form aggregated particles having a size corresponding to the toner diameter, and the toner particles are obtained by heating at a temperature higher than the glass transition point of the resin fine particles to conduct fusion and coalescence, followed by washing and drying. These processes are preferred since toner particles having arbitrary shape, i.e., from an irregular shape to a spherical shape, can be obtained.

In the formation of the aggregated particles, the dispersions of the raw materials may be mixed at a time to conduct aggregation, but the following manner can also be conducted. The balance of the amounts of the ionic dispersants of the respective polarities is declined in the initial stage, and it is subjected to ionic neutralization by using an inorganic metallic salt, such as calcium nitrate, or a polymer of an inorganic metallic salt, such as polyaluminum chloride, so as to form mother aggregated particles of the first step at a temperature lower than the glass transition point. As the second step, after stabilization, a particle dispersion having the polarity and the addition amount adjusted is added thereto compensate the declination of balance of polarity, and furthermore, depending on necessity, slight stabilization is conducted by heating to a temperature lower than the glass transition point of the resin contained in the mother particles and the additional particles. Thereafter, fusion and coalescence are conducted by heating to a temperature higher than the glass transition point of the resin fine particles. The coagulation operation may be conducted stepwise in plural times.

Examples of the polymer used as the resin fine particles of the invention, while not particularly limited, include a homopolymer of a monomer including a styrene compound, such as styrene, p-chlorostyrene and α-methylstyrene, an ester having a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate and 2-ethylhexyl methacrylate, a vinyl nitrile, such as acrylonitrile and methacrylonitrile, a vinyl ether, such as vinyl methyl ether and vinyl isobutyl ether, a vinyl ketone, such as vinyl methyl ketone, vinyl ethyl ketone and vinyl isopropenyl ketone, and an polyolefin, such as ethylene, propylene and butadiene, a copolymer obtained by combining two or more of them, a mixture thereof, an epoxy resin, a polyester resin, a polyurethane resin, a polyamide resin, a cellulose resin, a polyether resin, a non-vinyl condensation resin, a mixture of them and the vinyl series resins, and a graft polymer obtained by polymerizing the vinyl series monomer in the presence of the resins herein.

In the case of a vinyl series monomer, the resin fine particle dispersion can be formed by conducting emulsion polymerization by using an ionic surfactant. In the case of other resins that is lipophilic and can be dissolved in a solvent having a relatively small solubility in water, the resin is dissolved in the solvent, and the resulting solution is dispersed to a fine particle form in water by a disperser, such as a homogenizer, along with an ionic surfactant or a polymeric electrolyte, followed by evaporating the solvent by heating or reducing pressure, so as to obtain the resin fine particle dispersion.

The central diameter (median diameter) of the fine particles in the resulting resin fine particle dispersion of the invention is suitably 1 μm or less, preferably from 50 to 400 nm, and more preferably from 70 to 350 nm.

The central diameter of the resin fine particles is measured, for example, by a laser diffraction type particle size distribution measuring apparatus (LA-700, produced by Horiba Ltd.).

The releasing agent used in the invention is preferably a substance having a subjective maximum endothermic peak measured according to ASTMD 3418-8 at 50 to 140° C. When it is lower than 50° C., offset is liable to occur on fixing. When it exceeds 140° C., the fixing temperature is increased, and the smoothness on the surface of the fixed image cannot be obtained, so as to deteriorate the gross property. The measurement of the subjective maximum endothermic peak is conducted, for example, by using DSC-7, produced by Perkin Elmer, Inc. The temperature compensation at the detection part of the apparatus is conducted by using the melting points of indium and zinc, the compensation of heat quantity is conducted by using the heat of fusion of indium. A sample is carried on a pan made of aluminum, and the measurement is conducted by setting a vacant pan for control at a temperature increasing rate of 10° C. per minute.

Specific examples of the releasing agent used in the invention include a low molecular weight polyolefin, such as polyethylene, polypropylene and polybutene, a silicone exhibiting a softening point by heating, an aliphatic amide, such as oleic acid amide, erucic acid amide, ricinoleic acid amide and stearic acid amide, vegetable wax, such as carnauba wax, rice wax, candelilla wax, wood wax and jojoba oil, animal wax, such as bees wax, mineral or petroleum wax, such as montan wax, ozokerite, ceresin, paraffin wax, microcrystalline wax and Fischer-Tropsch wax, and a modification product thereof.

The wax is dispersed in water along with an ionic surfactant and a polymeric acid or a polymeric base, and is heated to a temperature higher than the melting point thereof and is simultaneously subjected to dispersion operation to a fine particle form by a homogenizer or a pressure discharge disperser (Gorin Homogenizer, produced by Gorin, Inc.) having a function of applying a strong sharing force, so as to form a dispersion of particles having a diameter of 1 μm or less.

The releasing agent is added preferably in an amount of from 5 to 25% by weight based on the total weight of the solid component constituting the toner from the standpoint of ensuring the peeling property of the fixed image on the oilless fixing system.

The particle diameter of the resulting releasing agent particle dispersion is measured, for example, by a laser diffraction type particle size distribution measuring apparatus (LA-700, produced by Horiba Ltd.).

In the case where the releasing agent is used, it is preferred that after aggregating the resin fine particles, the coloring agent particles and the releasing agent particles, a resin fine particle dispersion is further added to adhere the resin fine particles on the surface of the aggregated particles from the standpoint of ensuring the charging property and the durability.

The following coloring agents, for example, may be used in the invention.

Examples of a black pigment include carbon black, copper oxide, manganese dioxide, aniline black, activated carbon, non-magnetic ferrite and magnetite.

Examples of a yellow pigment include chrome yellow, zinc chromate, yellow iron oxide, Cadmium Yellow, Chrome Yellow, Hansa Yellow, Hansa Yellow 10G, Benzidine Yellow G, Benzidine Yellow GR, Suren Yellow, Quinoline Yellow and Permanent Yellow NCG.

Examples of an orange pigment include red chrome yellow, Molybdenum Orange, Permanent Orange GTR, Pyrazolone Orange, Vulcan Orange, Benzidine Orange G, Indanthrene Brilliant Orange RK and Indanthrene Brilliant Orange GK.

Examples of a red pigment include colcothar, Cadmium Red, red lead oxide, mercury sulfide, Watchung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eosine Red and Alizarine Lake.

Examples of a blue pigment include Prussian Blue, Cobalt Blue, Alkaline Blue Lake, Victoria Blue Lake, Fast Sky Blue, Indanthrene Blue BC, Aniline Blue, Ultramarine Blue, Carcoil Blue, Methylene Blue Chloride, Phthalocyanine Blue, Phthalocyanine Green and Malachite Green Oxalate.

Examples of a violet pigment include manganese violet, Fast Violet B and Methyl Violet Lake.

Examples of a green pigment include chromium oxide, Chrome Green, Pigment Green, Malachite Green Lake and Final Yellow Green G.

Examples of a white pigment include zinc flower, titanium oxide, antimony white and zinc sulfide.

Examples of an extender pigment include baryte powder, barium carbonate, clay, silica, white carbon, talc and alumina white.

Examples of a dye include various dyes, such as basic, acidic, dispersion and direct dyes, such as nigrosin, Methylene Blue, Rose Bengal, Quinoline Yellow and Ultramarine Blue.

These coloring agents are used singly or as a mixture. The dispersion of the coloring agent particles can be prepared by subjecting the coloring agent, for example, to a rotation sharing type homogenizer, a media type disperser, such as a ball mill, a sand mill and an attritor, and a high-pressure counter collision type disperser. The coloring agents can be dispersed in an aqueous system by a homogenizer using a surfactant having a polarity.

The coloring agent in the invention is selected from the standpoint of hue, chroma, brightness, weather resistance, OHP transparency, and dispersibility in the toner.

The coloring agent can be added in an amount of from 4 to 15% by weight based on the solid component constituting the toner.

In the case where a magnetic material is used as a black coloring agent, it may be added in an amount of from 12 to 240% by weight as different from the other coloring agent.

The mixing amount of the coloring agent described in the foregoing is such an amount that is necessary to ensure the coloring property upon fixing. Furthermore, when the central diameter (median diameter) of the coloring agent particles in the toner is from 100 to 330 nm, the OHP transparency and the coloring property can be ensured.

The central diameter of the coloring agent particles is measured, for example, by a laser diffraction type particle size distribution measuring apparatus (LA-700, produced by Horiba Ltd.).

In the case where the toner of the invention is used as a magnetic toner, magnetic powder may be contained in the toner. Specifically, a substance that is magnetized in a magnetic field is employed, and examples thereof include ferromagnetic powder, such as iron, cobalt and nickel, and a compound, such as ferrite and magnetite.

In the case where the toner of the invention is obtained in an aqueous phase, it is necessary to pay attention to the transferability of the magnetic material to the aqueous phase, and it is preferred that the surface of the magnetic material is previously modified, for example, by a hydrophobic treatment.

In the toner of the invention, a charge controlling agent may be used to further improve and stabilize the charging property. As the charge controlling agent, various charge controlling agents that are generally used, examples of which include a quaternary ammonium salt compound, a nigrosin series compound, a dye containing a complex of aluminum, iron or chromium, and a triphenylmethane series pigment, and a material that is difficult to be dissolved in water is preferred from the standpoint of control of the ion strength influencing the stability upon aggregation and coalescence and reduction in pollution due to waste water.

In the toner of the invention, inorganic fine particles may be added in a wet system for stabilizing the charging property. As the inorganic fine particles, those that are generally used as an external additive for a toner, such as silica, alumina, titania, calcium carbonate, magnesium carbonate and tricalcium phosphate, can be used after dispersing with an ionic surfactant, a polymeric acid or a polymeric base.

In order to impart fluidity and to improve the cleaning property, inorganic fine particles, such as silica, alumina, titania and calcium carbonate, or resin fine particles, such as vinyl resins, polyester and silicone, may be added to the surface of the toner of the invention in a dry state under application of sharing force.

In the invention, a surfactant is used for emulsion polymerization of the resin, dispersion of the pigment, dispersion of the resin fine particles, dispersion of the releasing agent, aggregation and stabilization of the aggregated particles. Specific examples thereof include an anionic surfactant, such as a sulfate series compound, a sulfonate series compound, a phosphate series compound and a soap series compound, and a cationic surfactant, such as an amine salt series compound and a quaternary ammonium salt series compound, and it is effective to use them in combination with a nonionic surfactant, such as a polyethylene glycol series compound, an alkylphenol ethyleneoxide series compound and a polyvalent alcohol series compound. As the device for dispersion, ordinary ones can be employed, for example, a rotation sharing type homogenizer and those containing media such as a ball mill, a sand mill and a Dyno-mill.

After completing the fusion and coalescence step of the aggregated particles, the toner particles are obtained through arbitrary steps including a washing step, a solid-liquid separation step and a drying step. It is preferred to conduct the washing step by substitution washing with ion exchanged water from the standpoint of charging property. While the solid-liquid separation step is not particularly limited, suction filtration and pressure filtration are preferably conducted from the standpoint of productivity. Furthermore, while the drying step is also not particularly limited, freeze drying, flash jet drying, fluidized drying and vibration fluidized drying are preferably employed from the standpoint of productivity.

The toner of the invention thus obtained suitably has an apparent weight average molecular weight of from 25,000 to 55,000, and preferably from 30,000 to 48,000. When the weight average molecular weight is less than 25,000, there are cases where the aggregation force of the binder resin is liable to be reduced to deteriorate the peeling property on oilless fixing. When it exceeds 55,000, the smoothness upon fixing becomes poor to decrease the gloss although the peeling property upon oilless fixing is good.

The toner of the invention suitably has an apparent glass transition point Tg of from 45 to 52° C., and preferably from 48 to 52° C. When Tg is lower than 45° C., the aggregation force of the binder resin itself in a high temperature region is decreased to cause hot offset on fixing. When it exceeds 52° C., there are cases where sufficient fusion cannot be obtained and the gloss of the fixing sheet is lowered.

The toner of the invention suitably has an accumulated volume average particle diameter $D_{50}$ of from 3.0 to 9.0 $\mu$m, and preferably from 3.0 to 8.0 $\mu$m. When $D_{50}$ is less than 3.0 $\mu$m, there are cases where the charging property becomes insufficient and the developing property is deteriorated. When it exceeds 9.0 $\mu$m, the resolution of the image is lowered.

The toner of the invention preferably has a volume average particle size distribution index GSDv of 1.30 or less, and a ratio of GSDv and a number average particle size distribution index GSDp (GSDv/GSDp) of 0.95 or more. When GSDv is higher than 1.30, the resolution is lowered, and when (GSDv/GSDp) is less than 0.95, the charging property is lowered, which causes image defects, such as scattering of the toner and fogging.

The accumulated volume average particle diameter $D_{50}$ and the average particle size distribution index in the invention can be obtained in the following manner. Based on the particle size distribution measured by a measuring apparatus, such as a Coulter counter TAII (produced by Nikkaki Co. Ltd.) and Multisizer II (produced by Nikkaki Co., Ltd.), the volume and the number of the particles are drawn from the small diameter side as an accumulated distribution corresponding to respective divided particle size ranges (channels). The particle diameter at accumulation of 16% is designated as a volume $D_{16v}$ and a number $D_{16p}$, the particle diameter at accumulation of 50% is designated as a volume $D_{50v}$ and a number $D_{50p}$, and the particle diameter at accumulation of 84% is designated as a volume $D_{84v}$ and a number $D_{84p}$. By using these values, the volume average particle size distribution index GSDv is obtained as $(D_{84v}/D_{16v})^{1/2}$, and the number average particle size distribution index GSDp is obtained as $(D_{84p}/D_{16p})^{1/2}$.

The toner of the invention suitably has a shape factor SF1 of from 100 to 140, and preferably from 110 to 125 from the standpoint of the image forming property. The shape factor SF1 in the invention can be obtained in the following manner. An optical micrograph of the toner scattered on slide glass is imported into a Lusex image analyzer through a video camera, and the peripheral length (ML) and the projected area (A) are measured for 50 or more toner particles. The shape factor SF1 of the toner is obtained as a value obtained by dividing a square of the peripheral length by the projected area, i.e., $ML^2/A$.

The toner of the invention suitably has an absolute value of a charging amount of from 20 to 40 $\mu$C/g, and preferably from 15 to 35 $\mu$C/g. When the charging amount is lower than 20 $\mu$C/g, background contamination (fogging) is liable to occur. When it exceeds 40 $\mu$C/g, the image density is liable to be decreased. The ratio of charging amount in summer season (high temperature and humidity: 28° C., 85% RH) to the charging amount in winter season (low temperature and humidity: 10° C., 30% RH) is suitably in the range of from 0.5 to 1.5, and preferably from 0.7 to 1.3. When the ratio is outside the scope, it is not practically preferred since the environment dependency of the charging property becomes large to lower the stability in charging.

By employing the configuration described in the foregoing in the invention, the balance between the aggregation force and the flexibility of the binder resin is ensured, and the fixing property, such as the adhesion property of the fixed image, the peeling property of the fixed image, the bending resistance of the fixed image and the surface gloss and the OHP transparency of the fixed image, can be improved.

The toner for developing an electrostatic image of the invention can be applied to an ordinary electrophotographic process. For example, an electrostatic latent image is formed on an electrostatic latent image holding member, and the electrostatic latent image is developed by a developing device to form a toner image, which is then transferred to a transfer material to obtain an image. In the case where a full color image is formed, images are accumulated by using a transfer drum or an intermediate transfer material, or a tandem system is employed, so as to form the full color image.

The toner for developing an electrostatic image of the invention can be applied to a fixing device that is used in an ordinary electrophotographic duplicator. Examples of the fixing device include a pressurizing and heating fixing device using a heating roll and a pressure roll. A fixing device using a heating roll having a fluorine resin layer is preferably employed since it is suitable for oilless fixing. One having a perfluoroalkoxy resin layer is particularly preferred.

A fixing device that can be operated in a high rate at a low pressure with low electric power is proposed in recent years, and an example thereof is a fixing device using a belt, a schematic diagram thereof is shown in FIG. 1. In this case, the fixing region can be wide, and the device can be operated at a low pressure with low electric power. The device is also suitable for high speed operation.

In the fixing device shown in FIG. 1, numeral 51 denotes a heating roll, and 53 denotes a pressure member having a belt B. The heating roll 51 contains thereinside a heater 51*h*, and a surface layer 51*a* is a layer having a releasing property, for example, a PFA layer. The pressure member 53 contains thereinside a belt guide 59, a pressure pad 56 for contacting under pressure on the heating roll, and a supporting member 54 for supporting the pad, and further contains, depending on necessity, a lubricating agent retaining member 57 for coating a lubricating agent. A toner image T is fixed on a fixing material, such as paper, by the heating roll and the pressure member.

The invention will be described in detail below with reference to the examples, but the invention is not construed as being limited thereto.

The toners are prepared in the following manner. The resin particle dispersions, the coloring agent particle dispersions and the releasing agent particle dispersion described below are prepared and mixed in a prescribed proportion. A polymer of a metallic salt is added to the resulting mixture under stirring to conduct ionic neutralization, so as to form aggregated particles. An inorganic hydroxide is then added thereto to adjust the pH of the system from weak acidity to neutral, it is heated to a temperature higher than the glass transition point of the resin fine particles to conduct fusion and unification. After completing the reaction, the objective toner is obtained through the steps of sufficient washing, solid-liquid separation and drying.

The preparation methods of the dispersions will be described below.

(Preparation of Resin Fine Particle Dispersion (1))

| | |
|---|---|
| Styrene | 308 parts by weight |
| n-Butyl acrylate | 92 parts by weight |
| Acrylic acid | 6 parts by weight |
| Propanediol diacrylate | 1.0 part by weight |
| Dodecane thiol | 2.7 parts by weight |

The components are mixed to prepare a solution. Separately, 4 parts by weight of an anionic surfactant (Dowfax, produced by Rhodia Inc.) is dissolved in 550 parts by weight of ion exchanged water, which is then added to the solution and dispersed and emulsified in a flask. 50 parts by weight of ion exchanged water having 6 parts by weight of ammonium persulfate dissolved therein is added thereto over 10 minutes under stirring and mixing. After sufficiently replacing the system with nitrogen, the flask is heated on an oil bath under stirring until the system reaches 70° C., followed by continuing the emulsion polymerization for 5 hours, so as to obtain an anionic resin fine particle dispersion (1) having a central diameter of the fine particles of 178 nm, a glass transition point of 49.7° C., a weight average molecular weight of 38,000 and a solid content of 42%.

(Preparation of Resin Fine Particle Dispersion (2))

The same procedures as in the preparation of the resin fine particle dispersion (1) are repeated except that the addition amount of propanediol diacrylate is changed to 2.0 parts by weight, so as to prepare an anionic resin fine particle dispersion (2) having a central diameter of the fine particles of 165 nm, a glass transition point of 51.9° C., a weight average molecular weight of 48,000 and a solid content of 42%.

(Preparation of Resin Fine Particle Dispersion (3))

The same procedures as in the preparation of the resin fine particle dispersion (1) are repeated except that the addition amount of styrene is changed to 292 parts by weight, the addition amount of butyl acrylate is changed to 108 parts by weight, and the addition amount of propanediol diacrylate is changed to 1.4 parts by weight, so as to prepare an anionic resin fine particle dispersion (3) having a central diameter of the fine particles of 191 nm, a glass transition point of 45.1° C., a weight average molecular weight of 42,000 and a solid content of 42%.

(Preparation of Resin Fine Particle Dispersion (4))

The same procedures as in the preparation of the resin fine particle dispersion (1) are repeated except that 0.75 part by weight of divinylbenzene is added instead of propanediol diacrylate, so as to prepare an anionic resin fine particle dispersion (4) having a central diameter of the fine particles of 173 nm, a glass transition point of 50.4° C., a weight average molecular weight of 36,000 and a solid content of 42%.

(Preparation of Resin Fine Particle Dispersion (5))

The same procedures as in the preparation of the resin fine particle dispersion (3) are repeated except that addition amount of styrene is changed to 320 parts by weight, the addition amount of the n-butyl acrylate is changed to 80 parts by weight, and 2.0 parts by weight of divinylbenzene is added instead of propanediol diacrylate, so as to prepare an anionic resin fine particle dispersion (5) having a central diameter of the fine particles of 230 nm, a glass transition point of 48.9° C., a weight average molecular weight of 44,000 and a solid content of 42%.

(Preparation of Resin Fine Particle Dispersion (6))

The same procedures as in the preparation of the resin fine particle dispersion (1) are repeated except that the addition amount of propanediol diacrylate is changed to 0.5 parts by weight, so as to prepare an anionic resin fine particle dispersion (6) having a central diameter of the fine particles of 190 nm, a glass transition point of 46.7° C., a weight average molecular weight of 34,000 and a solid content of 42%.

(Preparation of Resin,Fine Particle Dispersion (7))

The same procedures as in the preparation of the resin fine particle dispersion (1) are repeated except that the addition amount of propanediol diacrylate is changed to 3.0 parts by weight, so as to prepare an anionic resin fine particle dispersion (7) having a central diameter of the fine particles of 178 nm, a glass transition point of 46.7° C., a weight average molecular weight of 34,000 and a solid content of 42%.

(Preparation of Resin Fine Particle Dispersion (8))

The same procedures as in the preparation of the resin fine particle dispersion (1) are repeated except that addition amount of styrene is changed to 352 parts by weight, the addition amount of the n-butyl acrylate is changed to 48 parts by weight, and 2.5 parts by weight of divinylbenzene is added instead of propanediol diacrylate, so as to prepare an anionic resin fine particle dispersion (8) having a central diameter of the fine particles of 200 nm, a glass transition point of 53.7° C., a weight average molecular weight of 34,000 and a solid content of 42%.

(Preparation of Resin Fine Particle Dispersion (9))

The same procedures as in the preparation of the resin fine particle dispersion (1) are repeated except that addition amount of styrene is changed to 280 parts by weight, the addition amount of the n-butyl acrylate is changed to 120 parts by weight, and the addition amount of propanediol diacrylate is changed to 8.0 parts by weight, so as to prepare an anionic resin fine particle dispersion (9) having a central diameter of the fine particles of 193 nm, a glass transition point of 61.3° C., a weight average molecular weight of 58,000 and a solid content of 42%.

(Preparation of Coloring Agent Particle Dispersion (1))

| | |
|---|---|
| Yellow pigment (PY180, produced by Clariant Japan Co., Ltd.) | 50 parts by weight |
| Nonionic surfactant (Nonipole 400, produced by Kao Corp.) | 5 parts by weight |
| Ion exchanged water | 200 parts by weight |

The components are mixed and dissolved, and it is dispersed for 10 minutes by a homogenizer (Ultra-Turrax, produced by Ika Works, Inc.), so as to prepare a coloring agent particle dispersion (1) having a central diameter of 168 nm and a solid content of 21.5%.

(Preparation of Coloring Agent Particle Dispersion (2))

The same procedures as in the preparation of the coloring agent particle dispersion (1) except that a cyan pigment (copper phthalocyanine B15:3, produced by Dainichiseika Color and Chemicals Mfg. Co., Ltd.) is used instead of the yellow pigment, so as to prepare a coloring agent particle dispersion (2) having a central diameter of 177 nm and a solid content of 21.5%.

(Preparation of Coloring Agent Particle Dispersion (3))

The same procedures as in the preparation of the coloring agent particle dispersion (1) except that a magenta pigment (PR122, produced by Dainippon Ink and Chemicals, Inc.) is used instead of the yellow pigment, so as to prepare a coloring agent particle dispersion (3) having a central diameter of 186 nm and a solid content of 21.5%.

(Preparation of Coloring Agent Particle Dispersion (4))

The same procedures as in the preparation of the coloring agent particle dispersion (1) except that a black pigment (carbon black, produced by Cabot, Inc.) is used instead of the yellow pigment, so as to prepare a coloring agent particle dispersion (4) having a central diameter of 159 nm and a solid content of 21.5%.

(Preparation of Releasing Agent Particle Dispersion)

| | |
|---|---|
| Paraffin wax (HNP0190, melting point: 85° C., produced by Nippon Seiro Co., Ltd.) | 50 parts by weight |
| Cationic surfactant (Sanisol B50, produced by Kao Corp.) | 5 parts by weight |
| Ion exchanged water | 200 parts by weight |

The components are heated to 95° C. and sufficiently dispersed in a homogenizer (Ultra-Turrax, produced by Ika Works, Inc.), and it is then subjected to a dispersion treatment in a pressure discharge disperser (Gorin Homogenizer, produced by Gorin, Inc.), so as to prepare a releasing agent particle dispersion having a central diameter of 180 nm and a solid content of 21.5%.

EXAMPLE 1

(Preparation of Toner Particles)

| | |
|---|---|
| Resin fine particle dispersion (1) | 200 parts by weight |
| Coloring agent particle dispersion (1) | 40 parts by weight |
| Releasing agent particle dispersion | 40 parts by weight |
| Polyaluminum chloride | 1.23 parts by weight |

The components are sufficiently mixed and dispersed in a round flask made of stainless steel with a homogenizer (Ultra-Turrax, produced by Ika Works, Inc.), and the flask is then heated on an oil bath for heating to 48° C. under stirring, followed by maintaining at 48° C. for 60 minutes. 68 parts by weight of the resin fine particle dispersion (1) is then further added thereto and gradually stirred.

After the pH of the system is adjusted to 6.5 with a sodium hydroxide aqueous solution of 0.5 mol/L, the flask of stainless steel is sealed, and under continuous stirring by using a magnetic seal, it is heated to 95° C., followed by maintaining for 4 hours. After completing the reaction, cooling and filtration are conducted, and the product is sufficiently washed with ion exchanged water, followed by subjecting to solid-liquid separation by Nutsche suction filtration. The product is again dispersed in 3 L of ion exchanged water at 40° C. and stirred at 300 rpm for 15 minutes to conduct washing. The washing operation is repeated 5 times, and when the filtrate exhibits a pH of 6.56, an electric conductivity of 7.1 $\mu$S/cm and a surface tension of 71.0 per kmol, solid-liquid separation is conducted by Nutsche suction filtration using No. 5A filter paper, followed by continuing vacuum drying for 12 hours, so as to obtain the toner particles.

The particle diameter of the toner particles is measured by a Coulter counter, and the toner particles have an accumulated volume average particle diameter $D_{50}$ of 5.4 $\mu$m, a volume average particle size distribution index GSDv of 1.19, and a ratio of the volume average particle size distribution index GSDv and the number average particle size distribution index GSDp of 1.11. The shape factor SF1 of the toner particles obtained by shape observation by a Lusex image analyzer is 115.7, i.e., a spherical shape. When the cross section of the toner is observed by a transmission electron microscope (TEM), it is found that the releasing agent is dispersed in the toner particles, and the central diameter (median diameter) of the releasing agent particles is 320 nm, with the central diameter of the coloring agent particles being 183 nm.

The toner particles have a weight average molecular weight (Mw) of 34,200 and a glass transition point Tg of 49.1° C. The molecular weight between crosslinking points (Mc) obtained by dynamic viscoelasticity measurement of the toner particles is $7.5\times10^8$, and $\log_{10}$ (molecular weight between crosslinking points/crosslinking density) is 16.3.

(Preparation of Developer)

1.2 parts by weight of hydrophobic silica (TS720, produced by Cabot, Inc.) is added to 50 parts by weight of the toner particles, and mixed in a sample mill to obtain an external addition toner.

A ferrite carrier having an average particle diameter of 50 $\mu$m coated with 1% of polymethyl methacrylate (produced by Soken Chemical Co., Ltd.) and the external addition toner are weighed to be a toner concentration of 5%, and they are mixed in a ball mill for 5 minutes to prepare a developer.

(Evaluation of Toner)

The resulting developer is applied to a modified machine of A-Color duplicator 635 produced by Fuji Xerox Co., Ltd., and the fixing property of the toner is evaluated by using J Paper produced by Fuji Xerox Co., Ltd. as transfer paper at a process speed adjusted to 180 mm/s. As a result, it is confirmed that the oilless fixing property using the PFA tube roller is good, and the transfer paper is peeled without any resistance. The surface gloss of the transfer paper is good. When the fixed image is folded into two and rubbed up with nail, and then the fixing sheet is opened, the fixing property of the fixed image on the fixing sheet is good, and no drop off of the image is observed at the folded part. Thus, it is found that the fixed image is excellent in bending resistance.

The fixing property of the toner is evaluated in the same manner by using an OHP sheet (B/W produced by Fuji Xerox Co., Ltd.). It is confirmed that the transparency of the image on the OHP sheet is good, and a transparent image without turbidity is obtained.

An unfixed image is formed by using the toner on the modified machine of A-Color duplicator 635 in the same manner as in the foregoing, and the unfixed image is then fixed by using the fixing device of high speed, low pressure and low electric power type shown in FIG. 1.

The peeling property on the fixing device is good, and it is confirmed that peeling is attained without any resistance, and no offset is observed. Furthermore, the gloss property of the fixing sheet is also good.

The transparency on an OHP sheet is good, and a transparent image without turbidity is obtained. When the fixed image is folded into two and then opened, the fixing property of the fixed image on the fixing sheet is good, and no drop off of the image is observed. Thus, it is confirmed that good fixing property is obtained.

When the charging property of the toner is measured, the toner exhibits good charging property, i.e., −28 $\mu$C/g at 23° C., 60% RH (ordinary environment), −33 $\mu$C/g at 10° C., 30% RH (winter environment), and −25 $\mu$C/g at 28° C., 85% RH (summer environment), and thus it is found that the toner is excellent in environmental dependency. The resulting image is clear, and no defect, such as smoking of toner and fogging, is observed.

EXAMPLE 2

Toner particles are obtained in the same manner as in Example 1 except that the resin fine particle dispersion (1)

is changed to the resin fine particle dispersion (2), and the coloring agent particle dispersion (1) is changed to the coloring agent particle dispersion (2).

The resulting toner particles have an accumulated volume average particle diameter $D_{50}$ of 5.61 μm, a volume average particle size distribution index GSDv of 1.21, a ratio of the volume average particle size distribution index GSDv and the number average particle size distribution index GSDp of 1.09, and a shape factor SF1 of 117.3, i.e., spherical. When the cross section of the toner is observed by a transmission electron microscope (TEM), it is found that the releasing agent is dispersed in the toner particles, and the central diameter (median diameter) of the releasing agent particles is 345 nm, with the central diameter of the coloring agent particles being 181 nm.

The toner particles have a weight average molecular weight of 47,000 and a glass transition point Tg of 51.8° C. The molecular weight between crosslinking points (Mc) obtained by dynamic viscoelasticity measurement of the toner particles is $5.4\times10^7$, and $\log_{10}$ (molecular weight between crosslinking points/crosslinking density) is 14.7.

An external addition toner is obtained by using the toner particles in the same manner as in Example 1, and a developer is prepared in the same manner as in Example 1. When the fixing property of the toner is evaluated in the same manner as in Example 1, the toner is good in oilless fixing property using the PFA tube roller, peeling property and surface gloss property of transfer paper, and is excellent in bending resistance. The transparency of an OHP sheet is also good.

An unfixed image is formed by using the toner on the modified machine of A-Color duplicator 635 in the same manner as in the foregoing, and the unfixed image is then fixed by using the fixing device of high speed, low pressure and low electric power type shown in FIG. 1.

The peeling property on the fixing device is good, and it is confirmed that peeling is attained without any resistance, and no offset is observed. Furthermore, the gloss property of the fixing sheet is also good.

The transparency on an OHP sheet is good, and a transparent image without turbidity is obtained. When the fixed image is folded into two and then opened, the fixing property of the fixed image on the fixing sheet is good, and no drop off of the image is observed. Thus, it is confirmed that good fixing property is obtained.

When the charging property of the toner is measured, the toner exhibits good charging property, i.e., −27μC/g at 23° C., 60% RH (ordinary environment), −30 μC/g at 10° C., 30% RH (winter environment), and −24 μC/g at 28° C., 85% RH (summer environment), and thus it is found that the toner is excellent in environmental dependency. The resulting image is clear, and no defect, such as smoking of toner and fogging, is observed.

EXAMPLE 3

Toner particles are obtained in the same manner as in Example 1 except that the resin fine particle dispersion (1) is changed to the resin fine particle dispersion (3), and the coloring agent particle dispersion (1) is changed to the coloring agent particle dispersion (3).

The resulting toner particles have an accumulated volume average particle diameter $D_{50}$ of 5.53 μm, a volume average particle size distribution index GSDv of 1.23, a ratio of the volume average particle size distribution index GSDv and the number average particle size distribution index GSDp of 1.13, and a shape factor SF1 of 119.3, i.e., spherical. When the cross section of the toner is observed by a transmission electron microscope (TEM), it is found that the releasing agent is dispersed in the toner particles, and the central diameter (median diameter) of the releasing agent particles is 336 nm, with the central diameter of the coloring agent particles being 198 nm.

The toner particles have a weight average molecular weight of 30,000 and a glass transition point Tg of 45.0° C. The molecular weight between crosslinking points (Mc) obtained by dynamic viscoelasticity measurement of the toner particles is $6.4\times10^6$, and $\log_{10}$ (molecular weight between crosslinking points/crosslinking density) is 14.1.

An external addition toner is obtained by using the toner particles in the same manner as in Example 1, and a developer is prepared in the same manner as in Example 1. When the fixing property of the toner is evaluated in the same manner as in Example 1, the toner is good in oilless fixing property using the PFA tube roller, peeling property and surface gloss property of a fixing sheet, and is excellent in bending resistance. The transparency of an OHP sheet is also good.

An unfixed image is formed by using the toner on the modified machine of A-Color duplicator 635 in the same manner as in the foregoing, and the unfixed image is then fixed by using the fixing device of high speed, low pressure and low electric power type shown in FIG. 1.

The peeling property on the fixing device is good, and it is confirmed that peeling is attained without any resistance, and no offset is observed. Furthermore, the gloss property of the fixing sheet is also good.

The transparency on an OHP sheet is good, and a transparent image without turbidity is obtained. When the fixed image is folded into two and then opened, the fixing property of the fixed image on the fixing sheet is good, and no drop off of the image is observed. Thus, it is confirmed that good fixing property is obtained.

When the charging property of the toner is measured, the toner exhibits good charging property, i.e., −29 μC/g at 23° C., 60% RH (ordinary environment), −31 μC/g at 10° C., 30% RH (winter environment), and −24 μC/g at 28° C., 85% RH (summer environment), and thus it is found that the toner is excellent in environmental dependency. The resulting image is clear, and no defect, such as smoking of the toner and fogging, is observed.

EXAMPLE 4

Toner particles are obtained in the same manner as in Example 1 except that the resin fine particle dispersion (1) is changed to the resin fine particle dispersion (4), the coloring agent particle dispersion (1) is changed to the coloring agent particle dispersion (4), the aggregation temperature is changed to 42° C., and the time for fusion and coalescence is changed to 2 hours.

The resulting toner particles have an accumulated volume average particle diameter $D_{50}$ of 5.27 μm, a volume average particle size distribution index GSDv of 1.24, a ratio of the volume average particle size distribution index GSDv and the number average particle size distribution index GSDp of 1.24, and a shape factor SF1 of 123.4, i.e., spherical. When the cross section of the toner is observed by a transmission electron microscope (TEM), it is found that the releasing agent is dispersed in the toner particles, and the central diameter (median diameter) of the releasing agent particles is 420 nm, with the central diameter of the coloring agent particles being 203 nm.

The toner particles have a weight average molecular weight of 35,000 and a glass transition point Tg of 49.6° C. The molecular weight between crosslinking points (Mc) obtained by dynamic viscoelasticity measurement of the toner particles is $8.2\times10^7$, and $\log_{10}$ (molecular weight between crosslinking points/crosslinking density) is 15.0.

An external addition toner is obtained by using the toner particles in the same manner as in Example 1, and a developer is prepared in the same manner as in Example 1. When the fixing property of the toner is evaluated in the same manner as in Example 1, the toner is good in oilless fixing property using the PFA tube roller, peeling property and surface gloss property of a fixing sheet, and is excellent in bending resistance. The transparency of an OHP sheet is also good.

An unfixed image is formed by using the toner on the modified machine of A-Color duplicator 635 in the same manner as in the foregoing, and the unfixed image is then fixed by using the fixing device of high speed, low pressure and low electric power type shown in FIG. 1.

The peeling property on the fixing device is good, and it is confirmed that peeling is attained without any resistance, and no offset is observed. Furthermore, the gloss property of the fixing sheet is also good.

The transparency on an OHP sheet is good, and a transparent image without turbidity is obtained. When the fixed image is folded into two and then opened, the fixing property of the fixed image on the fixing sheet is good, and no drop off of the image is observed. Thus, it is confirmed that good fixing property is obtained.

When the charging property of the toner is measured, the toner exhibits good charging property, i.e., −27 μC/g at 23° C., 60% RH (ordinary environment), −30 μC/g at 10° C., 30% RH (winter environment), and −24 μC/g at 28° C., 85% RH (summer environment), and thus it is found that the toner is excellent in environmental dependency. The resulting image is clear, and no defect, such as smoking of toner and fogging, is observed.

EXAMPLE 5

Toner particles are obtained in the same manner as in Example 1 except that the resin fine particle dispersion (1) is changed to the resin fine particle dispersion (5), the aggregation temperature is changed to 53° C., and the time for fusion and coalescence is changed to 6 hours.

The resulting toner particles have an accumulated volume average particle diameter $D_{50}$ of 6.72 μm, a volume average particle size distribution index GSDv of 1.22, a ratio of the volume average particle size distribution index GSDv and the number average particle size distribution index GSDp of 1.20, and a shape factor SF1 of 120.7, i.e., spherical. When the cross section of the toner is observed by a transmission electron microscope (TEM), it is found that the releasing agent is dispersed in the toner particles, and the central diameter (median diameter) of the releasing agent particles is 580 nm, with the central diameter of the coloring agent particles being 232 nm.

The toner particles have a weight average molecular weight of 44,900 and a glass transition point Tg of 50.1° C. The molecular weight between crosslinking points (Mc) obtained by dynamic viscoelasticity measurement of the toner particles is $3.6\times10^6$, and $\log_{10}$ (molecular weight between crosslinking points/crosslinking density) is 14.0.

An external addition toner is obtained by using the toner particles in the same manner as in Example 1, and a developer is prepared in the same manner as in Example 1. When the fixing property of the toner is evaluated in the same manner as in Example 1, the toner is good in oilless fixing property using the PFA tube roller, peeling property and surface gloss property of transfer paper, and is excellent in bending resistance. The transparency of an OHP sheet is also good.

An unfixed image is formed by using the toner on the modified machine of A-Color duplicator 635 in the same manner as in the foregoing, and the unfixed image is then fixed by using the fixing device of high speed, low pressure and low electric power type shown in FIG. 1.

The peeling property on the fixing device is good, and it is confirmed that peeling is attained without any resistance, and no offset is observed. Furthermore, the gloss property of the fixing sheet is also good.

The transparency on an OHP sheet is good, and a transparent image without turbidity is obtained. When the fixed image is folded into two and then opened, the fixing property of the fixed image on the fixing sheet is good, and no drop off of the image is observed. Thus, it is confirmed that good fixing property is obtained.

When the charging property of the toner is measured, the toner exhibits good charging property, i.e., −27 μC/g at 23° C., 60% RH (ordinary environment), −30 μC/g at 10° C., 30% RH (winter environment), and −24 μC/g at 28° C., 85% RH (summer environment), and thus it is found that the toner is excellent in environmental dependency. The resulting image is clear, and no defect, such as scattering of toner and fogging, is observed.

Comparative Example 1

Toner particles are obtained in the same manner as in Example 1 except that the resin fine particle dispersion (1) is changed to the resin fine particle dispersion (6).

The resulting toner particles have an accumulated volume average particle diameter $D_{50}$ of 5.29 μm, a volume average particle size distribution index GSDv of 1.24, a ratio of the volume average particle size distribution index GSDv and the number average particle size distribution index GSDp of 1.21, and a shape factor SF1 of 120.2, i.e., spherical. When the cross section of the toner is observed by a transmission electron microscope (TEM), it is found that the releasing agent is dispersed in the toner particles, and the central diameter (median diameter) of the releasing agent particles is 319 nm, with the central diameter of the coloring agent particles being 192 nm.

The toner particles have a weight average molecular weight of 31,000 and a glass transition point Tg of 45.3° C. The molecular weight between crosslinking points (Mc) obtained by dynamic viscoelasticity measurement of the toner particles is $8.7\times10^8$, and $\log_{10}$ (molecular weight between crosslinking points/crosslinking density) is 16.6.

An external addition toner is obtained by using the toner particles in the same manner as in Example 1, and a developer is prepared in the same manner as in Example 1. When the fixing property of the toner is evaluated in the same manner as in Example 1, the peeling property on oilless fixing using the PFA tube roller is poor, and hot offset is observed, whereby a sufficient fixed image cannot be obtained.

When the charging property of the toner is measured, the toner exhibits good charging property, i.e., −27 μC/g at 23° C., 60% RH (ordinary environment), −30 μC/g at 10° C., 30% RH (winter environment), and −24 μC/g at 28° C., 85%

RH (summer environment) and thus it is found that the toner is excellent in environmental dependency. The image quality cannot be evaluated since no sufficient fixed image is obtained.

Comparative Example 2

Toner particles are obtained in the same manner as in Example 1 except that the resin fine particle dispersion (1) is changed to the resin fine particle dispersion (7).

The resulting toner particles have an accumulated volume average particle diameter $D_{50}$ of 5.41 μm, a volume average particle size distribution index GSDv of 1.20, a ratio of the volume average particle size distribution index GSDv and the number average particle size distribution index GSDp of 1.20, and a shape factor SF1 of 120.5, i.e., spherical. When the cross section of the toner is observed by a transmission electron microscope (TEM), it is found that the releasing agent is dispersed in the toner particles, and the central diameter (median diameter) of the releasing agent particles is 332 nm, with the central diameter of the coloring agent particles being 189 nm.

The toner particles have a weight average molecular weight of 34,000 and a glass transition point Tg of 45.9° C. The molecular weight between crosslinking points (Mc) obtained by dynamic viscoelasticity measurement of the toner particles is $3.6\times10^6$, and $\log_{10}$ (molecular weight between crosslinking points/crosslinking density) is 17.0.

An external addition toner is obtained by using the toner particles in the same manner as in Example 1, and a developer is prepared in the same manner as in Example 1. When the fixing property of the toner is evaluated in the same manner as in Example 1, the peeling property on oilless fixing using the PFA tube roller is poor, but the bending resistance and the surface gloss property of the fixing sheet are good. Upon output on an OHP sheet, hot offset is observed, whereby evaluation of an image cannot be conducted.

When the charging property of the toner is measured, the toner exhibits good charging property, i.e., −28 μC/g at 23° C., 60% RH (ordinary environment), −30 μC/g at 10° C., 30% RH (winter environment), and −24 μC/g at 28° C., 85% RH (summer environment), and thus it is found that the toner is excellent in environmental dependency.

Comparative Example 3

Toner particles are obtained in the same manner as in Example 1 except that the resin fine particle dispersion (1) is changed to the resin fine particle dispersion (8), the aggregation temperature is changed to 58° C., and the time for fusion and coalescence is changed to 10 hours.

The resulting toner particles have an accumulated volume average particle diameter $D_{50}$ of 9.12 μm, a volume average particle size distribution index GSDv of 1.32, a ratio of the volume average particle size distribution index GSDv and the number average particle size distribution index GSDp of 1.31, and a shape factor SF1 of 129.0, i.e., spherical. When the cross section of the toner is observed by a transmission electron microscope (TEM), it is found that the releasing agent is dispersed in the toner particles, and the central diameter (median diameter) of the releasing agent particles is 1,720 nm, with the central diameter of the coloring agent particles being 309 nm.

The toner particles have a weight average molecular weight of 29,000 and a glass transition point Tg of 52.7° C. The molecular weight between crosslinking points (Mc) obtained by dynamic viscoelasticity measurement of the toner particles is $3.6\times10^5$, and $\log_{10}$ (molecular weight between crosslinking points/crosslinking density) is 18.2.

An external addition toner is obtained by using the toner particles in the same manner as in Example 1, and a developer is prepared in the same manner as in Example 1. When the fixing property of the toner is evaluated in the same manner as in Example 1, the peeling property on oilless fixing using the PFA tube roller is good, but the bending resistance of the transfer paper is poor to form drop off of the image, and the surface gloss property of the transfer paper is also poor. The transparency on an OHP sheet is also poor.

When the charging property of the toner is measured, the toner exhibits good charging property, i.e., −25 μC/g at 23° C., 60% RH (ordinary environment), −31 μC/g at 10° C., 30% RH (winter environment), and −23 μC/g at 28° C., 85% RH (summer environment), and thus it is found that the toner is excellent in environmental dependency. The resulting image is unclear. No defect, such as smoking of the toner and fogging, is observed.

Comparative Example 4

Toner particles are obtained in the same manner as in Example 1 except that the resin fine particle dispersion (1) is changed to the resin fine particle dispersion (9), the aggregation temperature is changed to 40° C., and the time for fusion and coalescence is changed to 2 hours.

The resulting toner particles have an accumulated volume average particle diameter $D_{50}$ of 2.87 μm, a volume average particle size distribution index GSDv of 1.20, a ratio of the volume average particle size distribution index GSDv and the number average particle size distribution index GSDp of 1.33, and a shape factor SF1 of 117.6, i.e., spherical. When the cross section of the toner is observed by a transmission electron microscope (TEM), it is found that the releasing agent is dispersed in the toner particles, and the central diameter (median diameter) of the releasing agent particles is 220 nm, with the central diameter of the coloring agent particles being 188 nm.

The toner particles have a weight average molecular weight of 58,000 and a glass transition point Tg of 45.9° C. The molecular weight between crosslinking points (Mc) obtained by dynamic viscoelasticity measurement of the toner particles is $3.1\times10^6$, and $\log_{10}$ (molecular weight between crosslinking points/crosslinking density) is 13.9.

An external addition toner is obtained by using the toner particles in the same manner as in Example 1, and a developer is prepared in the same manner as in Example 1. When the fixing property of the toner is evaluated in the same manner as in Example 1, the peeling property on oilless fixing using the PFA tube roller is good, but the bending resistance of the transfer paper is poor to form drop off of the image, and the surface gloss property of the transfer paper is also poor. The transparency on an OHP sheet is also poor.

When the charging property of the toner is measured, the toner exhibits good charging property, i.e., −27 μC/g at 23° C., 60% RH (ordinary environment), −30 μC/g at 10° C., 30% RH (winter environment), and −24 μC/g at 28° C., 85% RH (summer environment), and thus it is found that the toner is excellent in environmental dependency. The resulting image is unclear. No defect, such as smoking of the toner and fogging, is observed.

The results obtained in Examples 1 to 5 and Comparative Examples 1 to 4 are summarized in Tables 1 and 2 below.

TABLE 1

| | Example 1 | Example 2 | Example 3 | Example 4 | Example 5 |
|---|---|---|---|---|---|
| Molecular weight between crosslinking points (Mc) | $7.5 \times 10^8$ | $5.4 \times 10^7$ | $6.4 \times 10^6$ | $8.2 \times 10^7$ | $3.6 \times 10^6$ |
| log (molecular weight between crosslinking point/ crosslinking density) | 16.3 | 14.7 | 14.1 | 15.0 | 14.0 |
| Weight average molecular weight | 34,200 | 47,000 | 30,000 | 35,000 | 44,900 |
| Glass transition temperature (Tg) (° C.) | 49.1 | 51.8 | 45.0 | 49.6 | 50.1 |
| Volume average particle size distribution index (GSDv) | 1.19 | 1.21 | 1.23 | 1.24 | 1.22 |
| GSDv/GSDp | 1.11 | 1.09 | 1.13 | 1.24 | 1.20 |
| Shape factor (SF1) | 115.7 | 117.3 | 119.3 | 123.4 | 120.7 |
| Releasing agent median diameter (nm) | 320 | 345 | 336 | 420 | 580 |
| Coloring agent median diameter (nm) | 183 | 181 | 198 | 203 | 232 |
| Volume average particle diameter of toner ($D_{50}$) | 5.40 | 5.61 | 5.53 | 5.27 | 6.72 |
| Charging amount (μC/g; 23° C., 60% RH) | −28 | −27 | −29 | −27 | −27 |
| Charging amount (μC/g; 10° C., 30% RH) | −33 | −30 | −31 | −30 | −30 |
| Charging amount (μC/g; 28° C., 85% RH) | −25 | −24 | −24 | −24 | −24 |
| Clearness of image | clear | clear | clear | clear | clear |
| Presence of scattering of toner and fogging | none | none | none | none | none |
| Hot offset of transfer paper | none | none | none | none | none |
| Peeling property of transfer paper | good | good | good | good | good |
| Bending resistance of fixed image | good | good | good | good | good |
| Surface gloss of transfer paper | good | good | good | good | good |
| Transparency of OHP sheet | good | good | good | good | good |

TABLE 2

| | Comparative Example 1 | Comparative Example 2 | Comparative Example 3 | Comparative Example 4 |
|---|---|---|---|---|
| Molecular weight between crosslinking points (Mc) | $8.7 \times 10^8$ | $3.6 \times 10^6$ | $3.6 \times 10^5$ | $3.1 \times 10^6$ |
| log (molecular weight between crosslinking point/ crosslinking density) | 16.6 | 17.0 | 18.2 | 13.9 |
| Weight average molecular weight | 31,000 | 34,000 | 29,000 | 58,000 |
| Glass transition temperature (Tg) (° C.) | 45.3 | 45.9 | 52.7 | 45.9 |
| Volume average particle size distribution index (GSDv) | 1.24 | 1.20 | 1.32 | 1.20 |
| GSDv/GSDp | 1.21 | 1.20 | 1.31 | 1.33 |
| Shape factor (SF1) | 120.2 | 120.5 | 129.0 | 117.6 |
| Releasing agent median diameter (nm) | 319 | 332 | 1,720 | 220 |
| Coloring agent median diameter (nm) | 192 | 189 | 309 | 188 |
| Volume average particle diameter of toner ($D_{50}$) | 5.29 | 5.41 | 9.12 | 2.87 |
| Charging amount (μC/g; 23° C., 60% RH) | −27 | −28 | −25 | −27 |
| Charging amount (μC/g; 10° C., 30% RH) | −30 | −30 | −31 | −30 |
| Charging amount (μC/g; 28° C., 85% RH) | −24 | −24 | −23 | −24 |
| Clearness of image | cannot be evaluated | cannot be evaluated | unclear | unclear |
| Presence of scattering of toner and fogging | cannot be evaluated | cannot be evaluated | none | none |
| Hot offset of transfer paper | present | present | good | good |
| Peeling property of transfer paper | poor | poor | good | good |
| Bending resistance of fixed image | cannot be evaluated | good | poor | poor |
| Surface gloss of transfer paper | cannot be evaluated | good | poor | poor |
| Transparency of OHP sheet | cannot be evaluated | cannot be evaluated | poor | poor |

In the invention, by employing the configuration described in the foregoing, formation of an image of good quality can be formed with excellent adhesion property of the fixed image on a fixing sheet, peeling property of a fixing sheet, hot offset resistance, bending resistance of the fixed image, surface gloss property of the fixed image and transparency on an OHP sheet, and high uniform charging property and stability, without fogging and smoking. Furthermore, according to the invention, excellent fixing property can be obtained on belt fixing.

What is claimed is:

1. A toner for developing an electrostatic latent image comprising a binder resin and a coloring agent, the toner having a molecular weight between crosslinking points Mc, which is obtained by a measurement of temperature dispersion on dynamic viscoelasticity, of from $3.6\times10^6$ to $7.5\times10^8$, and the molecular weight between crosslinking points Mc and a crosslinking density Me satisfying the following relationship:

$$14.0 \leqq \mathrm{Log}_{10}(Mc/Me) \leqq 16.5.$$

2. A toner for developing an electrostatic latent image as claimed in claim 1, wherein the toner has a glass transition temperature Tg of from 45 to 52° C.

3. A toner for developing an electrostatic latent image as claimed in claim 1, wherein the toner has a weight average molecular weight in a range of from 25,000 to 55,000.

4. A toner for developing an electrostatic latent image as claimed in claim 1, wherein the toner has a volume average particle size distribution index GSDv of 1.30 or less, and a ratio of the volume average particle size distribution index GSDv to a number average particle size distribution index GSDp of 0.95 or more.

5. A toner for developing an electrostatic latent image as claimed in claim 1, wherein the toner has a shape factor SF1 in a range of from 100 to 140.

6. A toner for developing an electrostatic latent image as claimed in claim 1, wherein particles of the coloring agent have a central diameter in a range of from 100 to 330 nm.

7. A toner for developing an electrostatic latent image as claimed in claim 1, wherein an amount of the coloring agent is in a range of from 4 to 15% by weight based on a total weight of a solid component constituting the toner.

8. A toner for developing an electrostatic latent image as claimed in claim 1, wherein the toner further comprises a releasing agent.

9. A toner for developing an electrostatic latent image as claimed in claim 8, wherein an amount of the releasing agent in the toner is in a range of from 5 to 25% by weight based on a total weight of the toner.

10. A toner for developing an electrostatic latent image as claimed in claim 1, wherein the toner has a charging amount of from 20 to 40 $\mu$C/g in absolute value.

11. A developer for an electrostatic latent image containing a carrier and a toner, the toner being a toner as claimed in claim 1.

12. A process for producing a toner as claimed in claim 1, the process comprising a step of mixing a resin particle dispersion containing resin particles dispersed therein and a coloring agent dispersion containing a coloring agent dispersed therein to aggregate the particles, and a step of fusing the aggregated particles by heating.

13. A process for producing a toner as claimed in claim 12, wherein the process further comprises, after the aggregation step, a step of additionally mixing the resin particle dispersion.

14. A process for producing a toner for developing an electrostatic latent image as claimed in claim 12, wherein the step of aggregating the fine particles further comprises mixing a releasing agent dispersion.

15. A process for producing a toner for developing an electrostatic latent image as claimed in claim 12, wherein a polymer of a metallic salt is additionally used in the step of aggregating the fine particles.

16. A process for forming an image comprising a step of developing an electrostatic latent image formed on a latent image holding member with a developer, a step of transferring a toner image thus formed to a transfer material, and a step of fixing the toner image to the transfer material, the toner being a toner as claimed in claim 1.

17. A process for forming an image as claimed in claim 16, wherein the process further comprises, after transferring step, a step of recovering the toner remaining on the latent image holding member, and a recycle step of bringing the recovered toner to the developer.

18. A process for forming an image as claimed in claim 16, wherein the transferring step is conducted without a following cleaning step.

19. A process for forming an image as claimed in claim 16, wherein fixing is conducted by using a belt in the fixing step.

* * * * *